United States Patent [19]

Jones

[11] 3,945,368

[45] Mar. 23, 1976

[54] COMPOUND BOW WITH ROTATIONAL INDICATORS FOR ECCENTRIC WHEELS ON BOW LIMBS

[76] Inventor: George T. Jones, 12277 LaCadena Drive, Colton, Calif. 92324

[22] Filed: Apr. 28, 1975

[21] Appl. No.: 572,119

[52] U.S. Cl. ..... 124/24 R; 124/30 A; 124/30 R

[51] Int. Cl.[2] ..... F41B 5/00

[58] Field of Search .... 124/30 R, 24 R, 23 R, 30 A; 116/116; 222/59, 60, 32, 33, 47

[56] References Cited

UNITED STATES PATENTS

| | | | |
|---|---|---|---|
| 1,558,635 | 10/1925 | Rutan | 212/39 B |
| 3,854,467 | 12/1974 | Hofmeister | 124/30 A |

*Primary Examiner*—Richard C. Pinkham
*Assistant Examiner*—William R. Browne
*Attorney, Agent, or Firm*—Herbert E. Kidder

[57] ABSTRACT

An eccentric indicator in combination with a compound bow the compound bow has rotatable eccentric wheels at the ends of the bow limbs, around which cables forming part of the bowstring are trained. The indicator comprises a pair of rotatable indicator wheels mounted above and below a simulated arrow shaft, about three-quarters of the distance back from the front end thereof. Flexible cords pass around pulleys mounted on the sides of the indicator wheels, and one cord is attached at one end of the bowstring close to the upper eccentric wheel, while the other cord is attached at one end to the bowstring close to the lower eccentric wheel. The other ends of the cords are attached to elastic cords, which are fastened to the front end of the shaft. When the device is used in place of an arrow and the bow is drawn, the indicator wheels are turned by the cords as the latter are pulled by the elastic cords to take up slack due to rotation of the eccentric wheels. If the eccentric wheels are turning in synchronism, the indicator wheels will rotate as though geared together. If the indicator wheels rotate at different rates, it is an indication that adjustment of the bow is necessary. The two indicator wheels, being located close together and in the archer's line of sight, enable him to see simultaneously the relative rates of rotation of the eccentric wheels on the ends of the bow.

7 Claims, 12 Drawing Figures

FIG. 1.
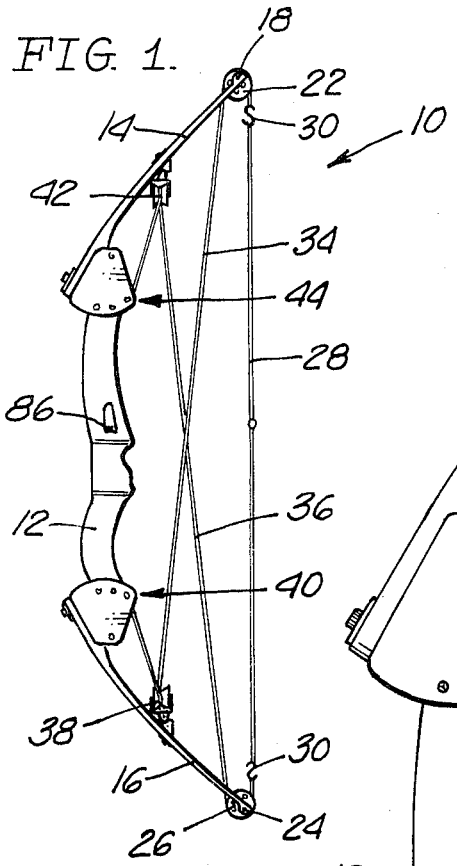
FIG. 2.
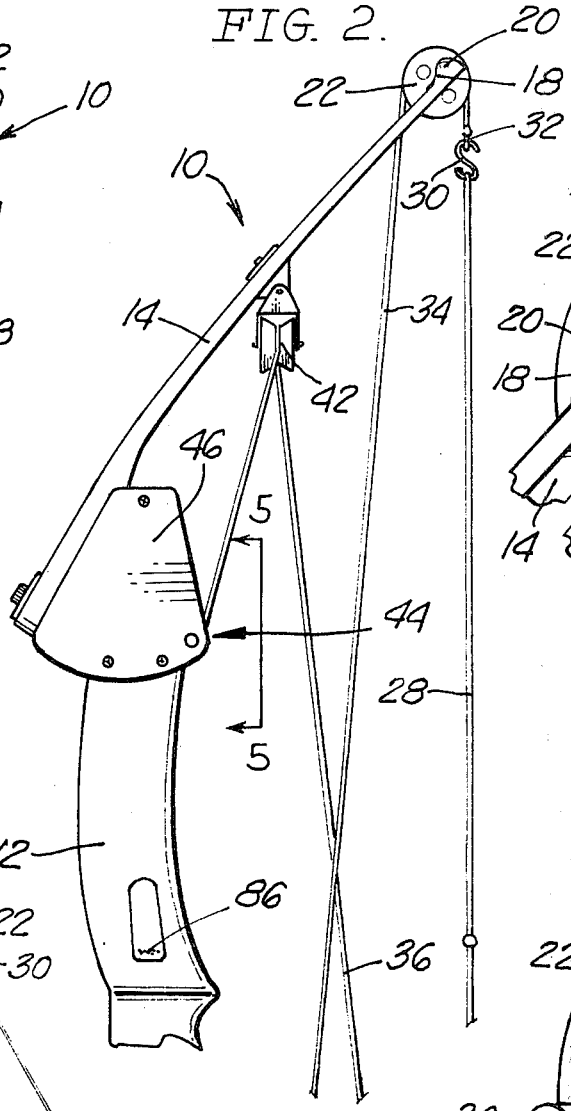
FIG. 3.
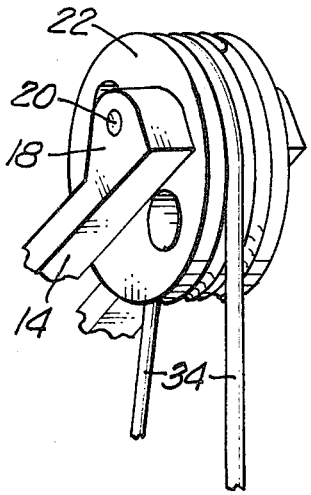
FIG. 4.
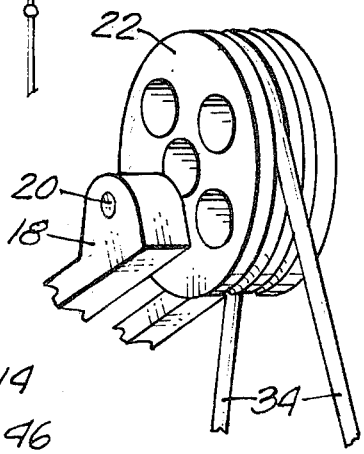
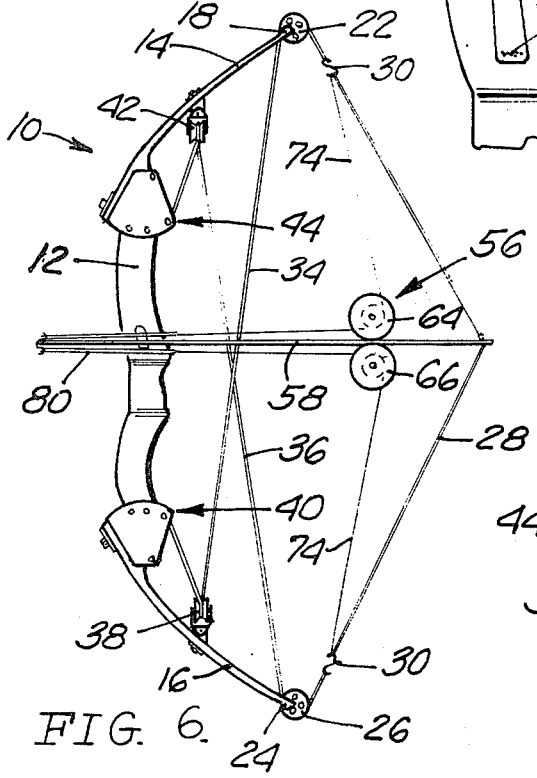
FIG. 6.
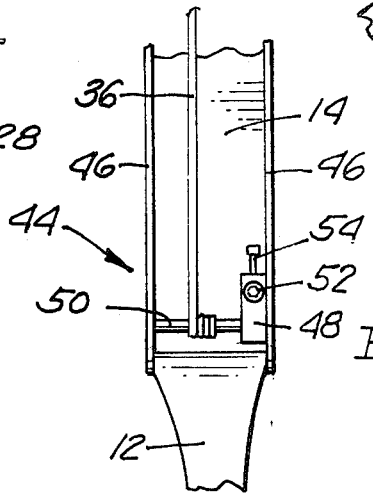
FIG. 5.

FIG. 11.
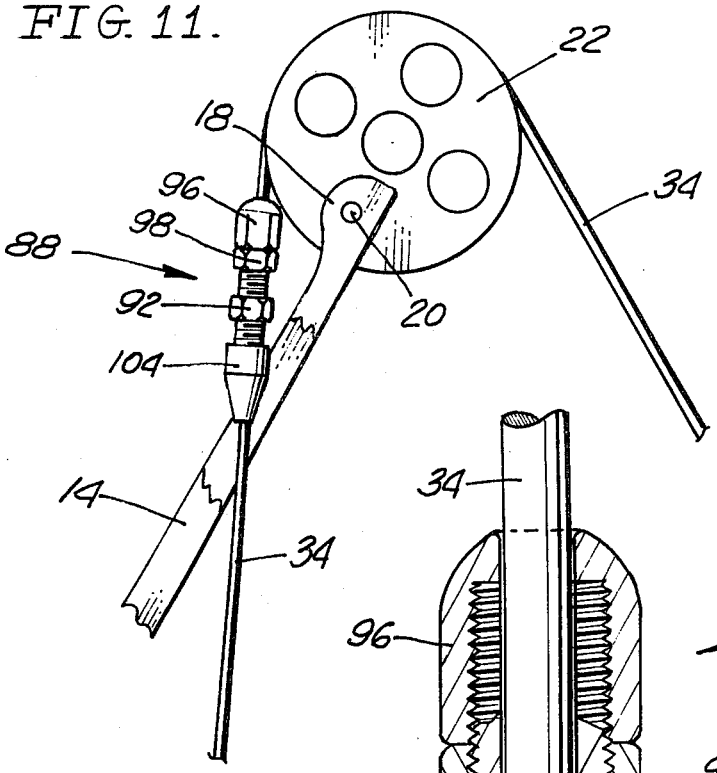
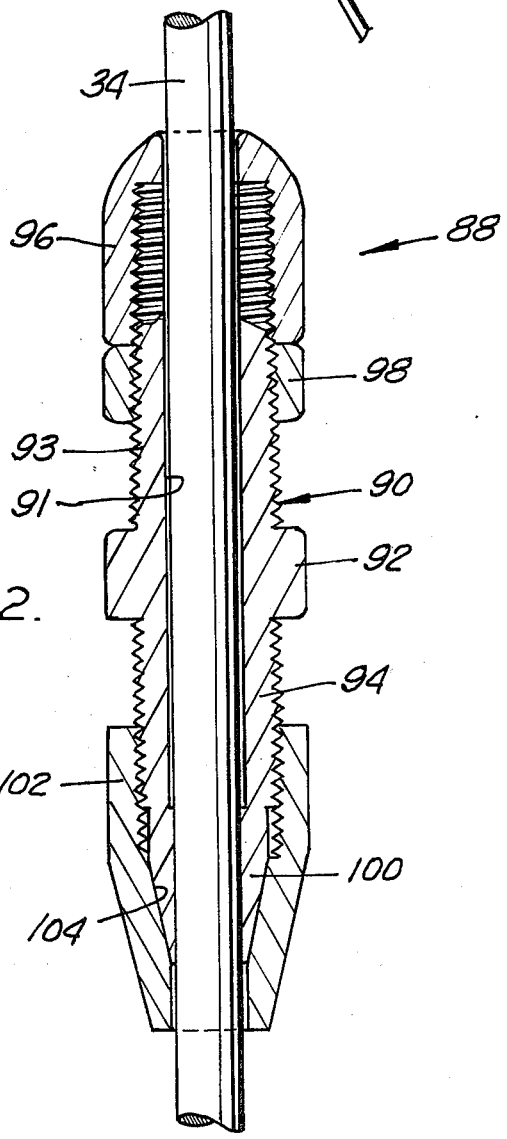
FIG. 12.

COMPOUND BOW WITH ROTATIONAL INDICATORS FOR ECCENTRIC WHEELS ON BOW LIMBS

BACKGROUND OF THE INVENTION

The present invention pertains to a device for use with a compound bow having eccentric wheels at the ends of the upper and lower limbs, around which the bowstring cables are trained. The compound bow is shown and described in U.S. Pat. No. 3,486,495 to H. W. Allen, to which reference may be had. The eccentric wheels each rotate approximately 180° as the bow is drawn to full draw, and these eccentric wheels, together with a block and tackle arrangement of the bowstring cables, are responsible for a unique characteristic of the compound bow whereby the draw weight of the bowstring increases rapidly to a maximum at about 78% of full draw distance, and then decreases about 20% as full draw is approached. For maximum speed and accuracy, it is essential that the upper and lower eccentric wheels rotate in exact synchronism, so that they peak and turn over at the same time. It is difficult to determine whether the eccentric wheels are turning in synchronism, as they are at opposite ends of the bow, and it is necessary to shift the eyes first to one end of the bow and then to the other. It is virtually impossible to tell by looking from one eccentric wheel to the other when they are turning in synchronism, and it has heretofore been a very tedious and time-consuming operation to get the eccentric wheels of a compound bow to peak and turn over at the same time.

SUMMARY OF THE INVENTION

The primary object of the present invention is to provide a simple, inexpensive device that enables an archer to see in a single glance how the two eccentric wheels of a compound bow are turning with respect to one another as he draws back on the bowstring.

Another object of the invention is to provide a device wherein indicator wheels showing the rotation of the eccentric wheels are mounted on a simulated arrow shaft, and the device is used with a compound bow in exactly the same manner as a regular arrow. The indicator wheels are thus located directly ahead of the archer's eyes, where they can be watched while sighting down the shaft.

These and other objects and advantages of the invention will become apparent to those skilled in the art from the following detailed description of the preferred embodiment thereof, with reference to the accompanying drawings.

BRIEF DESCRIPTION OF THE DRAWINGS

FIG. 1 is a side elevational view of a compound bow, of the type with which the present invention is intended to be used;

FIG. 2 is an enlarged view of the upper half of the bow, showing the cable and pulley arrangement;

FIG. 3 is a perspective view of the eccentric pulley wheel at the end of the upper limb, showing its position when the string is relaxed;

FIG. 4 is a view similar to FIG. 3, showing the position of the eccentric wheel when the string is fully drawn;

FIG. 5 is a fragmentary elevational view taken at 5—5 in FIG. 2;

FIG. 6 is a side elevation of the bow of FIG. 1, showing the device of the present invention being used;

FIG. 11 is a fragmentary elevational view of the upper eccentric pulley wheel, showing an adjustable cable stop for limiting the draw of the string; and FIG. 12 is an enlarged sectional view through the cable stop of FIG. 11.

DESCRIPTION OF THE PREFERRED EMBODIMENT

Figure 7:
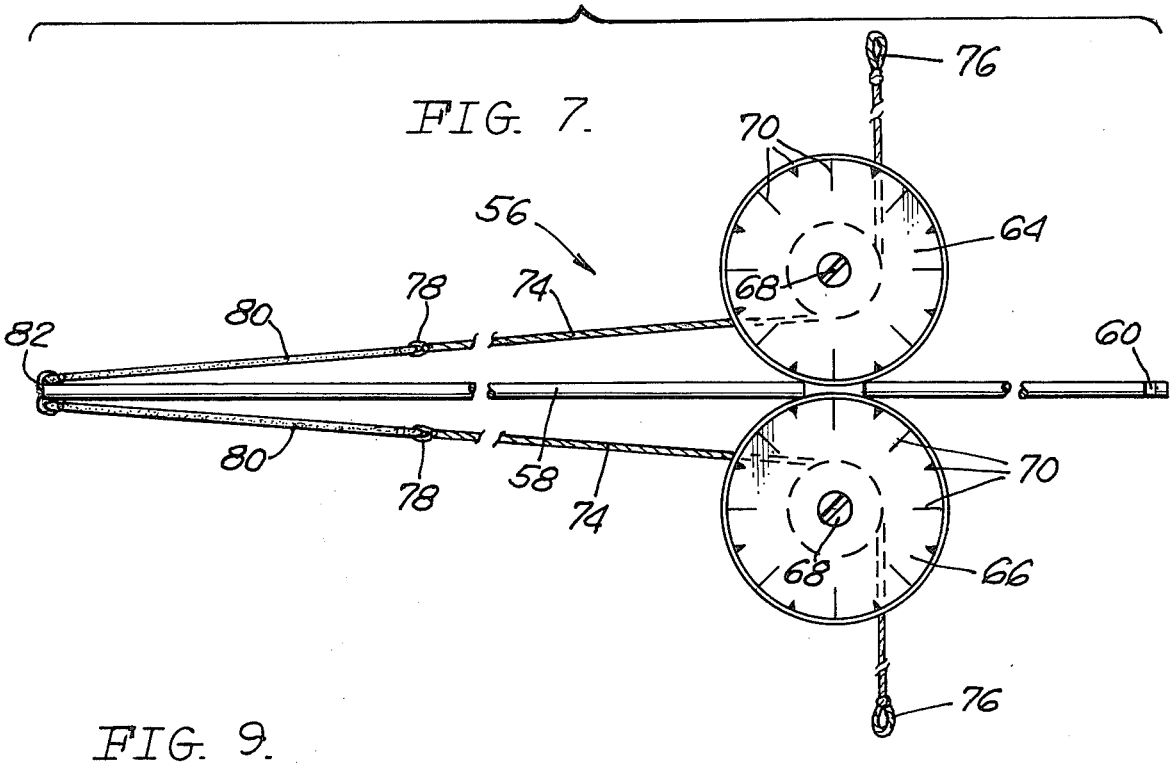
FIG. 7 is an enlarged fragmentary view of the invention, as seen from one side.

Attention is directed first to FIGS. 1–6, which show a compound bow that is essentially similar to that illustrated and described in U.S. Pat. No. 3,486,495 to H. W. Allen. The bow 10 is provided with a central handle section 22, having a pair of upper and lower limbs 14 and 16, respectively, extending outwardly from opposite sides thereof. Upper limb 14 is bifurcated and has bearing blocks 18, as illustrated in FIG. 3, which hold an axle pin 20 that rotatably supports an eccentric pulley wheel 22. In like manner, lower limb 16 is bifurcated at its end and has bearing blocks 24 that hold an axle shaft upon which an eccentric pulley wheel 26 is rotatably mounted.

A bow string 28 has S-shaped hooks 30 at each end, and these hooks are engaged through loops 32 in the ends of flexible steel cables 34 and 36. Cable 34 is trained around the upper eccentric pulley wheel 22 and extends back toward the lower limb 16, while cable 36 is trained around lower eccentric wheel 26 and extends upwardly toward the upper limb 14. Cable 34 passes around the idler pulley wheel 38 which is attached by a suitable mounting bracket to the inner surface of the lower limb 16, about midway between the ends thereof, and the end of the cable extends upwardly therefrom to an adjustable tuning device 40 on the lower end of handle section 12. In like manner, cable 36 passes around an idler pulley wheel 42 which is attached by a suitable bracket to the upper limb 14 about midway between the ends thereof, and the end of this cable extends down to an adjustable tuning device 44 on the upper end of handle section 12.

The adjustable tuning device 44 for cable 36 is shown in FIG. 5, but it will be understood that the corresponding device 40 for cable 24 is similar in all respects, and therefore the description of FIG. 5 applies to both of them. The turning devices 44 and 40 each comprise a pair of side plates 46 fixed to opposite sides of the handle section 12, and mounted between them is a worm screw gearbox 48 with a reel shaft 50 projecting laterally from one side thereof. Cable 36 is wrapped several times around the reel shaft 50 and fixedly attached thereto. Projecting from the near end of gearbox 48 is an adjusting cap screw 52 having a hex socket to receive a tool for turning the screw. When screw 52 is turned one direction or the other, reel shaft 50 rotates, winding up or unwinding the cable 36. A lock screw 54 locks the device in adjusted position.

The compound bow described to this point is not a part of the invention, but it is necessary that its construction and mode of operation be described so that the device of the present invention can be fully understood. A unique characteristic of the compound bow is the way that the draw weight of the bowstring increases rapidly out to about 22 inches, and then decreases about 20% at 28 inches of draw. This is due to the fact that the eccentric pulleys turn on their axle shafts about 180° from the position shown in FIG. 3 to that shown in FIG. 4. As the eccentric pulleys rotate in this manner, the longer radius of the eccentric swings outwardly and rearwardly toward the archer, thereby effectively increasing the effective length of the limbs at full draw. This increases the mechanical advantage at full draw. At the same time, cables 34 and 36 passing around idler pulleys 38 and 40, act as block and tackle to help bend the short stiff limbs 14 and 16. The combination of block and tackle, wherein the bending of one limb helps the bending of the other, together with the increasing mechanical advantage obtained by the rotating eccentrics as the bow approaches full draw, gives the compound bow extraordinary power, while at the same time reducing the draw weight at full draw.

For maximum speed and accuracy, it is essential that the upper and lower eccentric wheels 22, 26 peak and turn over at the same time. This may be affected by idiosyncracies of the archer's draw, or by the way the bow was set up and adjusted at the time of stringing. When the bow is in correct adjustment, the archer will feel only a single peak of power as he approaches full power, and the bow will shoot consistently in the direction that it is aimed, instead of consistently over-shooting or under-shooting the mark. When correctly adjusted, both of the eccentric wheels 22, 26 turn in perfect synchronism, and each time that the top wheel 22 turns through 1° of rotation, the bottom wheel 26 will also turn through 1° of rotation. If the wheels are not turning in perfect synchronism, they can be adjusted by turning one or the other of the tuning devices 40, 44 in the "take-up" direction. For example, should the lower wheel 26 break over ahead of the upper wheel 22, cable 36 on the lower wheel 26 would be taken up by turning the cap screw 52 of tuning device 44 in the direction to wind more cable onto the reel shaft 50. The upper tuning device 44 controls the lower wheel 46, and the lower tuning device 40 controls the upper wheel 22.

The difficulty, however, is that the archer cannot watch both the upper and lower wheels simultaneously while making his draw, and therefore adjusting the bow for perfect synchronism of the upper and lower wheels is a tedious and time-consuming operation. The present invention makes it possible to perform this adjustment quickly and easily.

Figure 9:
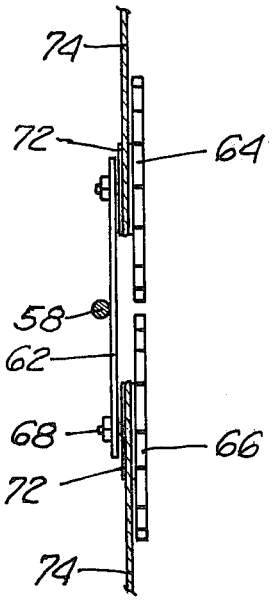
FIG. 9 is an end view of the device, as seen from 9—9 of FIG. 8.
Figure 8:
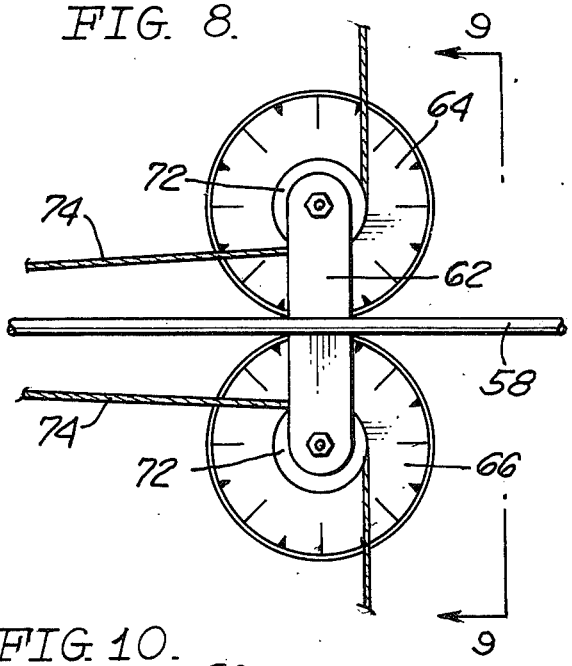
FIG. 8 is another view of the same, seen from the other side.
Figure 10:
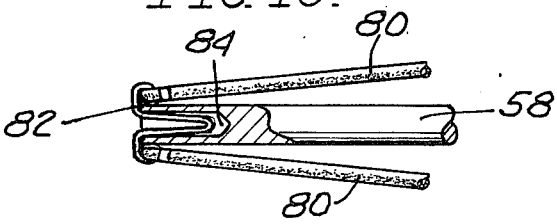
FIG. 10 is an enlarged fragmentary view, partially broken away, showing the front end of the device.

The device of the present invention is shown in FIGS. 6–10, where it is designated in its entirety by the reference numeral 56. The device 56 includes a straight, slender shaft 58 that is substantially identical to an arrow shaft, and has a notch 60 in one side thereof at the rear end to receive the bowstring 28. Mounted on the shaft 58 about three-quarters of the distance back from the front end thereof is a bracket 62 supporting two indicator wheels 64 and 66.

The wheels 64, 66 are rotatably mounted on pivot bolts 68, and each of the wheels is marked with a plurality of equidistant, angularly spaced graduation markings 70. Fixed to the wheels 64, 66 on the side facing the bracket 62 are pulley wheels 72, and trained around the wheels on the side adjacent the shaft 58 are flexible cords 74. One end of each of the cords 74 extends towards the corresponding eccentric wheel, and has a loop 76 at its outer end that is engaged over the S-shaped hook 30. The other end of each of the cords 74 extends forwardly along the shaft 58 to a point of attachment 78 with one end of an elastic cord 80. The elastic cord 80 continues fowardly along the shaft 58, and its other end is attached to an anchor fitting 82 which has a tongue that is inserted into a hole 84 in the end of the shaft.

The operation of the device 56 is as follows: With the two loops 76 of cords 74 hooked onto their respective S-shaped hooks 30, the shaft 58 is placed on an arrow rest 86 on the side of handle section 12, and bowstring 28 is placed in the notch 60. The bowstring and shaft 58 are then drawn back in the normal way, as when drawing an arrow. During the draw, cables 34 and 36 are pulled over their respective eccentric wheels 22, 26, causing the wheels to turn approximately 180 degrees on their pins 20. In so doing, the S-shaped hooks are pulled away from the eccentric wheels 22, 26, and this has the effect of moving the hooks 30 down slightly toward the indicator wheels 64, 66, as best shown in FIG. 6. It will be noted in FIG. 6 that bowstring 28, cord 74, and the rear end of shaft 58 form a triangle, in which the side formed by cord 74 becomes shorter as the bowstring is drawn, whereas the other two sides of the triangle remain constant in length. Such movement of the hooks 30 toward the wheels 64, 66 tends to slacken the cords 74, but the slackness is taken up by the elasticity of cords 80, which were stretched slightly when the loops 74 were hooked onto the S-hooks 30.

Thus, as bowstring 28 is drawn, cords 74 are pulled toward the front end of shaft 58, and their movement around pulleys 72 causes the top wheel 64 to rotate in the clockwise direction, and bottom wheel 66 to rotate in the counterclockwise direction. If both of the eccentric wheels 22, 26 are turning in synchronism, so that they both peak over at the same time, both indicator wheels 64, 66 will turn at exactly the same rate, and this will become immediately apparent to the archer, as he will see the graduation marks on wheel 64 approach and line up with corresponding graduation marks on wheel 66, almost as if they were geared together. Any slight difference in their rotational rates is instantly apparent, as graduations on onw wheel will appear to catch up with and pass corresponding graduations on the other wheel. If the top indicator wheel 64 is turning faster than the bottom wheel 66, it indicates that the top eccentric wheel 22 is peaking ahead of the bottom eccentric wheel 26. The corrective adjustment would be to turn tuning device 40 in the direction to wind some more of cable 34 on the reel shaft 50. At the same time, it may be necessary to make what is known as a "tiller height" adjustment, which is an adjustment of the bow that increases the loading on one or the other of limbs 14, 16.

After each adjustment, the device 56 is again placed on the bow, and drawn to full draw, while the archer watches the rotation of wheels 64, 66. When perfect adjustment is obtained, the wheels 64, 66 will turn in perfect synchronism, and a graduation mark on one wheel will line up with a corresponding graduation mark on the other wheel, and follow it in perfect registration. The location of the indicator wheels 64, 66 directly in the line of sight as the archer sights along the shaft 58 makes it possible for him to see in a single glance what is happening to opposite ends of the bow.

To insure that the archer will not overdraw the bow beyond its designed draw length, I provide a cable stop 88, which is shown in FIGS. 11 and 12. Cable stop 88 comprises a tubular sleeve 90 having an axial bore 91 through which cable 34 passes. At the center of the sleeve 90 is a hex head 92 to receive a wrench (not shown), and projecting from opposite ends of the hex head are threaded nipples 93 and 94. A round-nosed abutment cap 96 is screwed onto the end of the upper nipple 93, and is locked in place by means of a lock nut 98. The lower nipple 94 terminates in a split clutch cone 100, that is clamped to the cable 34 by means of a clamping nut 102. Clamping nut 102 has a conically tapered inner surface 104 having the same cone angle as clutch cone 100. Thus, as clamping nut 102 is screwed onto nipple 94, the split clutch cone 100 is clamped tightly onto cable 34, fixedly securing the cable stop to the cable.

The cable stop 88 is positioned on cable 34 so that abutment cap 96 touches the outer surface of eccentric wheel 22 at the exact instant of full draw. As the abutment cap 96 strikes the wheel 22, the archer feels a sudden and unmistakeable resistance to further draw of the bowstring, that signifies to him that the bow is at maximum draw, and should not be drawn any further. The cable stop 88 may be adjusted to any desired position along the cable 34 by merely loosening clamping nut 102 and sliding the device to the new position, at which point the clamping nut 102 is again tightened.

While I have shown and described in considerable detail what I believe to be the preferred form of my invention, it is to be understood that the invention is not limited to such details, but might take various other forms within the scope of the appended claims. For example, the invention might take the form of an attachment that clamps onto the side of a regular arrow, in which case the arrow shaft would substitute for shaft 58. The indicator wheels 64, 66 might then be mounted on the clamping bracket, and a suitable spring-winding arrangement could be used instead of elastic cords 80 to pull the cords 74 over the pulleys 72. Some forms of compound bow have the eccentric wheels located elsewhere than at the outer ends of the limbs.

What I claim is:

1. In combination with a compound bow having eccentric wheels rotatably mounted thereon, a cable passing around the wheels, said wheels each turning approximately 180° between the rest position and full draw, a device for visually comparing the rotational rates of said eccentric wheels, a bowstring, said device comprising:

a support;

a pair of movable indicators mounted on said support and positioned adjacent the nocking point of the bowstring where they can readily be seen by the archer as he draws the bowstring, said support being engageable by the bowstring and movable rewardly thereby; and means actuated by rotation of said eccentric wheels for driving the movable indicators so that a user may visually compare the relative rates of rotation of the indicators and the corresponding eccentric wheels with respect to one another.

2. The device of claim 1, wherein said movable indicators are mounted closely adjacent one another, one of said indicators being driven by the rotation of the eccentric wheel at the upper end of the bow, and the other indicator being driven by rotation of the eccentric wheel at the lower end of the bow.

3. The device of claim 2, wherein said indicators comprise a pair of indicator wheels rotatably mounted on said support, said indicator wheels having graduation markings provided thereon so that any relative rotation between them can be observed.

4. The device of claim 3, wherein each of said indicator wheels has a pulley fixed thereto, and said means for driving the indicator wheels comprises a pair of cords, each of said cords being trained around one of said pulleys, and each cord having one end attached to the bowstring adjacent the corresponding eccentric wheel, and resilient means attached to the other ends of said cords for taking up the cords as the eccentric wheels turn.

5. The device of claim 4, wherein said support comprises a long slender shaft with means at one end thereof to receive the bowstrings, a bracket fixed to said shaft upon which said indicator wheels are rotatably supported; and said resilient means comprises elastic members attached to the other ends of said cords for taking up the cords as the eccentric wheels turn, said elastic members being attached to a fitting at the front end of said shaft.

6. The device of claim 3, wherein said support comprises a long slender shaft substantially identical to an arrow shaft, with means at one end thereof to receive the bowstring, and a bracket fixed to said shaft; said indicator wheels being rotatably supported on said bracket.

7. The device of claim 1, wherein said means for driving said movable indicators comprises a pair of cords, each having one end attached to the bowstring adjacent the corresponding eccentric wheel, and resilient means attached to the other ends of said cords for taking up the cords as the eccentric wheels turn.

* * * * *